US008166788B2

(12) United States Patent
Röpke

(10) Patent No.: US 8,166,788 B2
(45) Date of Patent: May 1, 2012

(54) LIP-ROLLING AND FLANGING TOOL FOR BENDING BACK OR WIDENING FENDER-WHEELWELL EDGES

(76) Inventor: Thomas Röpke, Ahrensburg (DE)

( * ) Notice: Subject to any disclaimer, the term of this patent is extended or adjusted under 35 U.S.C. 154(b) by 456 days.

(21) Appl. No.: 12/382,873

(22) Filed: Mar. 26, 2009

(65) Prior Publication Data

US 2009/0241626 A1 Oct. 1, 2009

(30) Foreign Application Priority Data

Mar. 26, 2008 (DE) ..... 10 2008 015 887

(51) Int. Cl.
*B21D 19/00* (2006.01)

(52) U.S. Cl. ..... 72/210; 72/211; 72/705; 29/401.1

(58) Field of Classification Search ..... 72/210, 72/211, 215, 248, 705; 29/401.1
See application file for complete search history.

(56) References Cited

U.S. PATENT DOCUMENTS 1,775,968 A * 9/1930 Nelson ..... 72/392
1,813,012 A * 7/1931 Asher ..... 72/125
1,826,834 A * 10/1931 Shaw ..... 72/248
1,880,246 A * 10/1932 Greiner ..... 72/211
1,893,196 A * 1/1933 Buck ..... 72/248
2,274,032 A * 2/1942 Blair ..... 72/481.5
2,543,259 A 2/1951 Robbins
5,390,521 A 2/1995 Kerze
5,488,849 A 2/1996 Ropke

FOREIGN PATENT DOCUMENTS

DE 43 01 392 C2 7/1997

* cited by examiner

*Primary Examiner* — David Jones
(74) *Attorney, Agent, or Firm* — Shlesinger, Arkwright & Garvey LLP

(57) ABSTRACT

A lip-rolling and flanging tool for bending back and/or widening fender-wheelwell edges of motor vehicles, the tool having a flanging roll (46) that is attached through a telescoping tube arrangement (10) to an affixing flange (4) mountable on a wheel axle of the motor vehicle, and while generating a pressing force against the fender-wheelwell edge is pivotable together with the wheel axle, the flanging roll (46) is mounted in a forked support bracket (44) disposed at one end of the telescoping tube arrangement (10), which bracket is disposed in a rotatable and lockable manner between the clamping jaws (40, 40') attached to the telescoping tube arrangement (10'), the clamping jaws (40, 40') each have at least one recess or milled-out section (100,100') that interacts with a pin (103) disposed in the flanging-roll support bracket (44) so as to restrict the pivoting range of the flanging-roll support bracket (44).

4 Claims, 1 Drawing Sheet

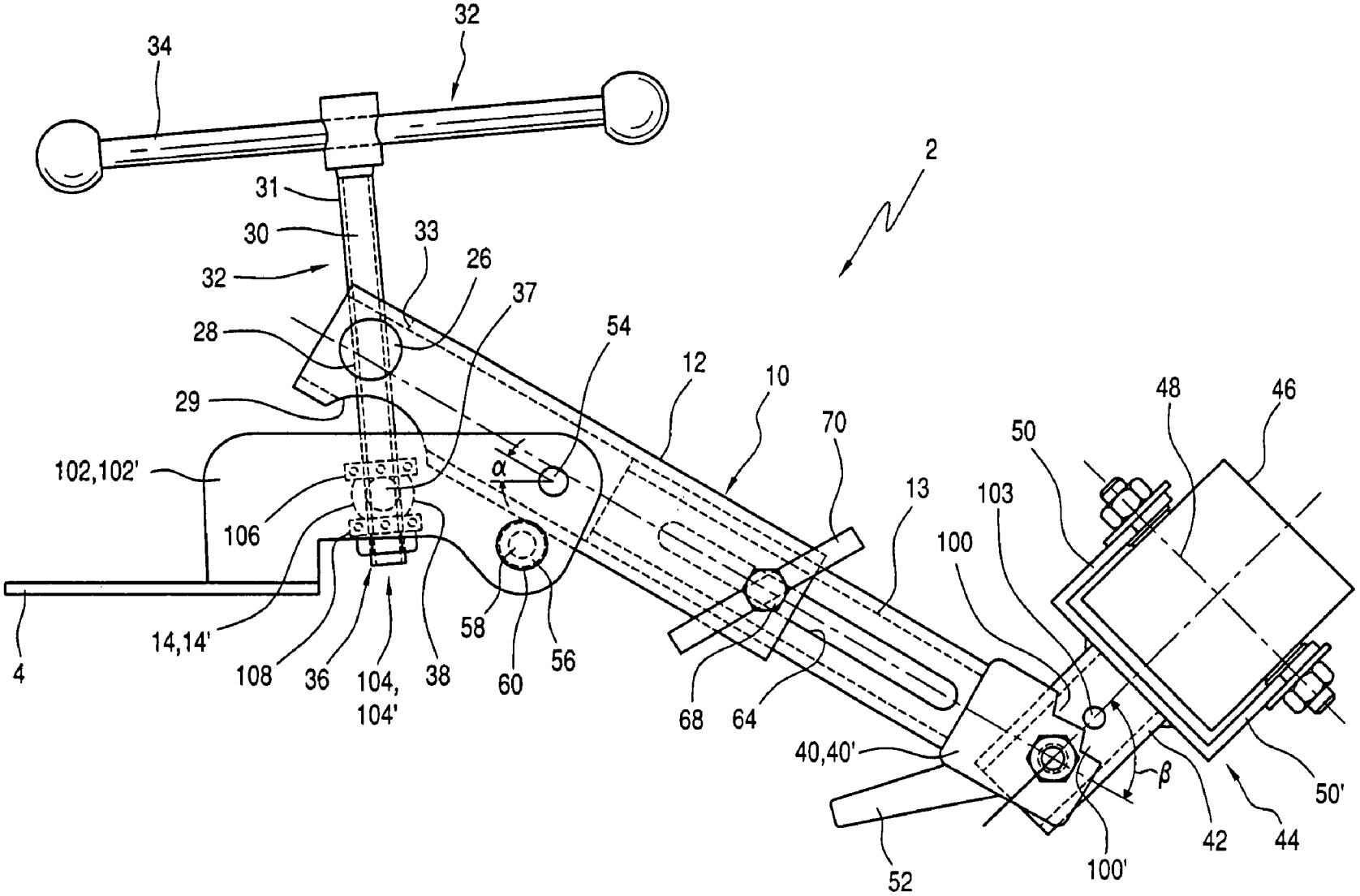
2
46
48
50
50'
44
42
β
100'
103
100
13
52
40,40'
70
64
68
10
12
54
56
60
58
α
37
26
33
38
104,
104'
36
108
106
14,14'
102,102'
29
28
32
31
30
32
34
4

LIP-ROLLING AND FLANGING TOOL FOR BENDING BACK OR WIDENING FENDER-WHEELWELL EDGES

FIELD OF THE INVENTION

The invention relates to a lip-rolling and flanging tool for bending back and/or widening fender-wheelwell edges of motor vehicles.

DESCRIPTION OF THE PRIOR ART

A lip-rolling and flanging tool of the referenced type is known from DE 43 01 392 C2. In principle, the known lip-rolling and flanging tool operates quite reliably. It has been found, however, that the flanging roll that is disposed at the end of the telescoping tube arrangement within a pivotable support bracket is restricted within the pivoting range only by the support bracket. The result is that there is a danger that the flanging roll will fly back when under a significant load, thereby possibly causing injury to the operator. In addition, there is a risk that the fender edge to be worked will be damaged in the process. In vehicles with disk brakes, the disadvantage has occasionally arisen whereby the rectangular planar legs of the affixing flange strike the brake calipers within the pivoting range of the wheel hub, with the result that the calipers first had to be removed before it was possible to begin with the lip-rolling and flanging procedure. Finally, another disadvantage has arisen in regard to the mounting of the threaded spindle. The threaded spindle actuated by means of a handle is mounted using washers in a freely rotatable manner within a fixed journal bearing between the two legs of the affixing flange. Here there was a danger that the washers could be damaged, and as a consequence the spindle could shear off under load.

The problem to be solved by this invention is therefore to design the lip-rolling and flanging tool of the type referenced at the outset so as to preclude the described disadvantages from occurring.

BRIEF SUMMARY OF THE INVENTION

The invention relates to a lip-rolling and flanging tool for bending back and/or widening fender-wheelwell edges of motor vehicles, comprising a flanging roll that is attached through a telescoping tube arrangement to an affixing flange mounted on the motor vehicle's wheel axle and is pivotable along with the wheel axle while generating a pressing force against the fender-wheelwell edge, wherein the flanging roll is supported within a forked support bracket disposed in a pivotable manner at one end of the telescoping tube arrangement, the support bracket being disposed in rotatable and lockable manner between two clamping jaws attached to the telescoping tube arrangement.

The invention proposes that the clamping jaws that rotatably and lockably receive the forked support bracket of the flanging roll each be provided with at least one milled-out section or recess that interacts with a pin disposed in the support bracket of the flanging roll, which pin restricts the pivoting range to the required work range when the support bracket is pivoted. This prevents overturning of the flanging roll when under load, and precludes the risk of injury to the operator and the risk of damaging the edge of the fender.

The development according to the invention provides U-shaped angled legs in place of a rectangular straight-extending shape for the planar legs enables sufficient clearance to be created within the pivoting range of the affixing flange for the brake calipers on the disk brakes of many vehicles. This design eliminates the need for removing the brake calipers before the lip-rolling and flanging procedure, thereby enabling significant labor time to be saved.

A further advantageous design is the threaded spindle actuated by the handle is supported by ball bearings above and below the shaft between the two legs of the affixing flange. The use of the ball bearings in place of the washers significantly reduces the frictional forces in the bearing, thereby significantly improving the service life of the support while precluding the danger that the threaded spindle could shear off.

BRIEF DESCRIPTION OF THE DRAWING

FIG. 1 illustrates a schematic side view of the lip-rolling and flanging tool according to the invention.

DETAILED DESCRIPTION OF THE INVENTION

FIG. 1 illustrates a tool 2 for lip-rolling and flanging the wheelwell edges of vehicle fenders.

Tool 2 comprises an annular affixing flange 4 including a circularly disposed universal slot array (not shown) for attachment to the axle of the motor vehicle after removal of the vehicle's wheel. Two rectangular, parallel, planar legs 102, 102' welded to affixing flange 4 extend away from affixing flange 4, between which legs a telescoping rectangular tube arrangement 10 is pivotably disposed.

This telescoping tube arrangement 10 comprises an external tube 12 in which an internal tube 13 is slidably disposed.

Internal tube 13 of telescoping rectangular tube arrangement 10 has two planar extensions in the form of clamping jaws 40, 40' at the end projecting from external tube 12, between which jaws the stem 42 of a forked support bracket 44 for a flanging roll 46 is rotatably mounted, the roll shaft 48 of which is rotatably mounted within the U-legs 50, 50' of support bracket 44. The two planar clamping jaws 40, 40' each have at least one milled-out section 100, 100' that interacts with a pin 103 disposed in flanging-roll support bracket 44 roll. When flanging-roll support bracket 44 along with flanging roll 46 is pivoted, milled-out sections 100 and/or 100' form a stop for pin 103, thereby restricting the pivoting range of flanging-roll support bracket 44 so as to preclude flanging-roll support bracket 44 along with flanging roll 46 from turning over when under load.

The inclination angle β between flanging roll 46 and telescoping rectangular tube arrangement 10 can be adjusted by means of locking lever 52, thereby matching flanging roll 46 to the angle of the fender-wheelwell edge.

In the end facing affixing flange 4, external tube 12 of telescoping tube arrangement 10 has a rotatably mounted shaft 26 comprising a central radial threaded through-hole 28 in which a threaded segment 31 of a threaded spindle 30 of a pulling device 32 including a handle 34 is disposed.

One end section 36 of threaded spindle 30 is disposed in a freely rotatable manner in a radial through-hole 37 of shaft 38 that is rotatably disposed between the two legs 102, 102' of affixing flange 4. The two legs 102, 102' are U-shaped such that the U-spaces 104, 104' enclosed by U-legs 102, 102' form a clearance for a brake caliper of a disk brake within the radial pivoting range of affixing flange 4. Based on this design, the planar legs 102, 102' can no longer strike the brake calipers of vehicles equipped with disk brakes. This design avoids the step of removing the brake calipers before the lip-rolling and flanging procedure.

One ball bearing each, 106, 108, supporting threaded-spindle end section 36 each is disposed above and below shaft 38. This measure minimizes frictional forces, with the result that the bearing arrangement has an improved service life. The danger that the threaded spindle could be sheared off is precluded.

At the bottom, external tube 12 of telescoping rectangular tube arrangement 10 has an arcurate recess 29 into which shaft 38 of legs 102, 102' can be pivoted. At the top on the flange-side end, external tube 12 has a recess 33 into which threaded spindle 30 can be pivoted.

Inclination angle β between flanging roll 46 and telescoping rectangular tube arrangement 10 can be adjusted by means of locking lever 52, so as to allow the flanging roll to be matched to the angle of the fender-wheelwell edge.

At the center, the two legs 102, 102' each have a borehole 14, 14'; shaft 38 is mounted in these boreholes. One borehole each (not shown) is located at the free ends of shaft 38; these boreholes are aligned with boreholes 14, 14', and screws (not shown) are inserted through these holes, which screws are screwed into axial threaded boreholes (not shown) of shaft 38.

External rectangular tube 12 has a borehole 54 at the two lateral rectangular sides, and on the bottom side has a welded-on bearing 56 along with a borehole 58 that runs parallel to borehole 54. The set-up of rectangular external tube 12 is effected in borehole 54 or borehole 58 as governed by the required adjustment range by means of a pin or a shaft 60 that is secured by a W-clip.

Internal tube 13 has a lateral slot 64 through which the threaded shaft of a locking screw 68 provided with a handle 70 projects, which screw is disposed in an inside-threaded section welded onto external tube 12 and can be screwed against the inside of the opposing rectangular side of internal tube 13 so as to lock internal tube 13 within external tube 12.

Operation of the tool is as follows: After affixing flange 4 has been attached to the wheel axle or vehicle axle, internal tube 13 is extended or retracted such that flanging roll 46 moves into the region of the fender-wheelwell edge. Subsequently, the inclination of the flanging roll (angle β) is matched to the angle of the fender-wheelwell edge. By rotating threaded spindle 30 and tightening telescoping rectangular tube arrangement 10, the angle α between telescoping rectangular tube arrangement and legs 102, 102' is reduced so as to generate a pressing force by flanging roll 46 on the fender-wheelwell edge. The bending back or widening of the fender-wheelwell edge is then effected by pivoting the tool along with the wheel axle of the motor vehicle after this edge has been heated up, for example, by means of a hot-air gun.

The invention claimed is:

1. A lip-rolling and flanging tool for reforming a motor vehicle fender wheelwell comprising:

a) a telescopic, elongated body member having a working end and a securing end;

b) an affixing flange extending from the securing end, the affixing flange configured to secure the first end of the tool to a vehicle axle for rotation therewith;

c) a flanging roller extending from the working end and rotatably mounted thereto within a forked support bracket, the flanging roller adapted to roll against a fender wheelwell and along an actuate path as the vehicle axle is rotated;

d) a pair of clamping jaws attached to the elongated body member in a rotatable and lockable manner, the forked support bracket is disposed between the pair of clamping jaws, the clamping jaws having at least one milled-out section extending therein and operatively associated with a pin member extending from the forked support bracket to limit pivoting of the same; and e) an adjustable affixing member, the adjustable fixing member is configured to variable fix the position of the flanging roller relative to a vehicle axle and simultaneously compress the flanging roller against a fender wheelwell so that rotation of the vehicle axle will cause the flanging roller to roll against the fender wheelwell along a uniform arc to reform the same.

2. A lip-rolling and flanging tool as in claim 1 wherein the affixing flange further include a pair of planar, parallel and generally U-shaped affixing legs extending therefrom that are pivotally mounted to the elongated body member whereby the U-shaped portions of each affixing leg are adapted to provide clearance for a brake caliper lying within the pivoting range of the affixing flange when the tool is in use.

3. A lip-rolling and flanging tool as in claim 2 and wherein the adjustable affixing member having a borehole extending through the securing end of the elongated body member and transverse thereto and a rotatable spindle member with handle that is operational therewith, the rotatable spindle member is threadedly received within the borehole and one end thereof is rotatably secured to the pair of U-shaped affixing legs and extends therebetween whereby rotation of the spindle member by the handle will selectively cause the elongated body member to pivot relative to the affixing flange and thereby adjust the angle (α) between the elongated body member and the pair of U-shaped legs.

4. A lip-rolling and flanging tool as in claim 3 and further including:

a) a shaft extending between the pair of U-shaped legs, the shaft for rotatably securing the spindle member to the pair of U-shaped affixing legs; and b) a pair of ball bearings for supporting the spindle member, one of the pair of ball bearing is disposed above the shaft and the other of the pair of ball bearings is disposed below the shaft to minimize frictional forces thereagainst.

* * * * *